US010780546B2

(12) United States Patent
Rouzbeh et al.

(10) Patent No.: US 10,780,546 B2
(45) Date of Patent: Sep. 22, 2020

(54) VARIABLE RADIUS SANDING BLOCK

(71) Applicants: Seyed Babak Rouzbeh, Tehran (IR); Seyedehshaghayegh Rouzmeh, Kirkland (CA)

(72) Inventors: Seyed Babak Rouzbeh, Tehran (IR); Seyedehshaghayegh Rouzmeh, Kirkland (CA)

( * ) Notice: Subject to any disclaimer, the term of this patent is extended or adjusted under 35 U.S.C. 154(b) by 332 days.

(21) Appl. No.: 15/960,060

(22) Filed: Apr. 23, 2018

(65) Prior Publication Data

US 2018/0304432 A1 Oct. 25, 2018

Related U.S. Application Data

(60) Provisional application No. 62/489,819, filed on Apr. 25, 2017.

(51) Int. Cl.

| | |
|---|---|
| ***B24B 23/04*** | (2006.01) |
| ***B24B 5/50*** | (2006.01) |
| ***B24B 5/35*** | (2006.01) |
| ***B24D 15/04*** | (2006.01) |

(52) U.S. Cl.

CPC ..... *B24B 23/046* (2013.01); *B24B 5/35* (2013.01); *B24B 5/50* (2013.01); *B24D 15/04* (2013.01)

(58) Field of Classification Search

CPC ..... B24B 23/046; B24B 5/35; B24B 5/50; B24D 15/04

USPC ..... 451/356, 557

See application file for complete search history.

(56) References Cited

U.S. PATENT DOCUMENTS

| | | | | | |
|---|---|---|---|---|---|
| 2,120,483 | A * | 6/1938 | Burger | B24D 15/02 | 451/557 |
| 3,540,160 | A * | 11/1970 | De Rose | B24D 15/00 | 451/344 |
| 4,887,396 | A * | 12/1989 | Lukianoff | B24D 15/04 | 451/523 |
| 5,054,248 | A | 10/1991 | Thayer | | |
| 5,337,523 | A * | 8/1994 | Walsh | B24D 15/04 | 15/245 |
| 5,895,316 | A * | 4/1999 | Williams | B24D 15/023 | 451/523 |
| 5,947,803 | A | 9/1999 | Gruner | | |
| 6,116,999 | A * | 9/2000 | Montross | B24D 15/04 | 451/523 |
| 6,296,558 | B1 * | 10/2001 | Poole | B24D 15/023 | 451/515 |
| 6,494,770 | B1 | 12/2002 | Carlson | | |
| 7,186,174 | B1 * | 3/2007 | Arnold | B24D 15/023 | 451/507 |
| 8,696,413 | B2 | 4/2014 | King et al. | | |

(Continued)

*Primary Examiner* — George B Nguyen

(74) *Attorney, Agent, or Firm* — Boudwin Intellectual Property; Daniel Boudwin

(57) ABSTRACT

A variable radius sanding block for sanding curved surfaces. The variable radius sanding block includes a base member and a plurality of variably sized radius patches. The base member is sized and proportioned to allow radius patches of varying size to be inserted, such that each of the radius patches will change the curvature of the sanding block upon insertion. The base member also having a folded flexible internal structure and a pair of flexible arms that facilitate insertion of radius patches of varying size. The radius patch includes a pair of grooves that receive the flexible arms of the base member and secure the base member to the radius patch.

11 Claims, 6 Drawing Sheets

(56) References Cited

U.S. PATENT DOCUMENTS

| | | | | |
|---|---|---|---|---|
| 2006/0199484 | A1* | 9/2006 | Brown | B24D 15/04<br>451/523 |
| 2017/0320194 | A1* | 11/2017 | Ryan | B24D 15/04 |

* cited by examiner

VARIABLE RADIUS SANDING BLOCK

CROSS REFERENCE TO RELATED APPLICATION

This application claims the benefit of U.S. Provisional Application No. 62/489,819 filed on Apr. 25, 2017. The above identified patent application is herein incorporated by reference in its entirety to provide continuity of disclosure.

BACKGROUND OF THE INVENTION

The present invention relates to the sanding of wood, musical instruments, and other rounded surfaces.

Sanding blocks conventionally are provided having a fixed curvature that is only intended to be used to sand objects of a corresponding curvature. In order for most wood workshops to be able to sand a wide range of surfaces they have to maintain several sanding blocks, where each one has a different curvature. For this reason, multiple sanding blocks in many wood workshops tend to take up substantial amounts of space. In order to address these concerns, the present invention provides a sanding block having a curved surface whose curvature can be changed to match the curvature of the curved surface that needs sanding.

SUMMARY OF THE INVENTION

In view of the foregoing disadvantages inherent in the known types of sanding blocks now present in the prior art, the present invention provides a variable radius sanding block wherein the same can be utilized for providing convenience for the user when sanding of wood, musical instruments, and other rounded surfaces.

It is therefore an object of the present invention to provide a new and improved means of sanding rounded surfaces that has all of the advantages of the known art and none of the disadvantages.

It is another object of the present invention to provide a variable radius sanding block assembly having a base member and a plurality of insertable radius patches of varying width and curvature, such that when one of the radius patches is inserted into the base member they combine to form a single structure having a rounded surface at one end.

Another object of the present invention is to provide a base member having a flexible folded internal structure and two flexible arms, such that the arms define an opening to receive a radius patch and for the folded internal structure to expand and contract so that the size of the opening defined by the flexible arms can be increased or decreased.

Yet another object of the present invention is to provide a base member and radius patch each having a pair of grooves and protruding lips, such that the grooves and protruding lips interlock with one another so that the base member securely retains the radius patch once inserted therein.

An additional object of the present invention is for radius patches of differing size to have correspondingly different colors in order to be more easily recognizable.

Another object of the present invention is to provide a variable radius sanding block that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
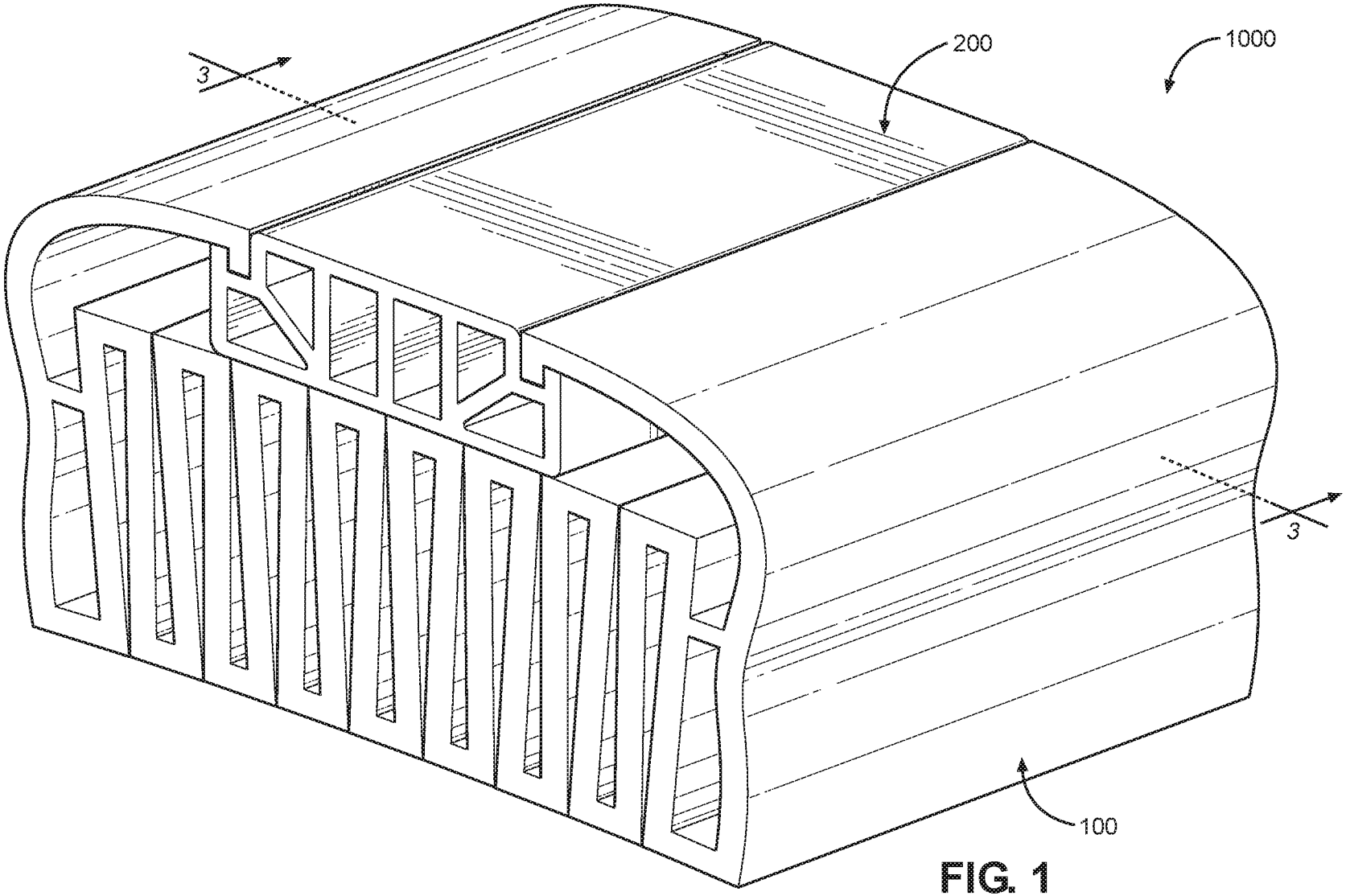
FIG. 1 shows a perspective view of an embodiment of a fully assembled variable radius sanding block.

Reference is made herein to the attached drawings. Like reference numerals are used throughout the drawings to depict like or similar elements of the variable radius sanding block. The figures are intended for representative purposes only and should not be considered to be limiting in any respect.

Referring now to FIG. 1, there is shown a perspective view of an assembled variable radius sanding block. The variable radius sanding block 1000 comprises a base member 100 and a plurality of variably sized radius patches 200. In the illustrated embodiment, assembly of the variable radius sanding block requires insertion of one of the radius patches 200 into the base member 100. In the illustrated embodiment, both the base member 100 and the radius patch 200 are made of an extruded plastic, such that the base member 100 is flexible and can be easily manipulated while the radius patch 200 is rigid and resistant to manipulation.

Figure 2A:
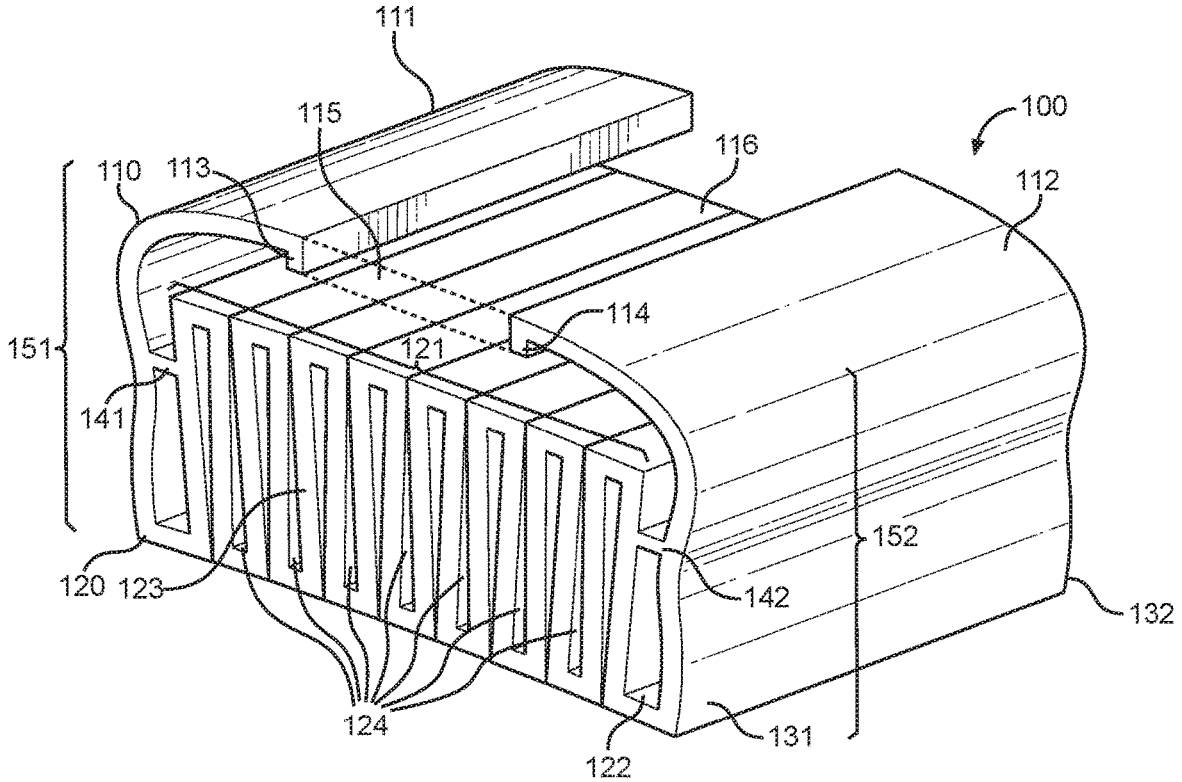
FIG. 2A shows a perspective view of the base member of the variable radius sanding block in a resting position.
Figure 2B:
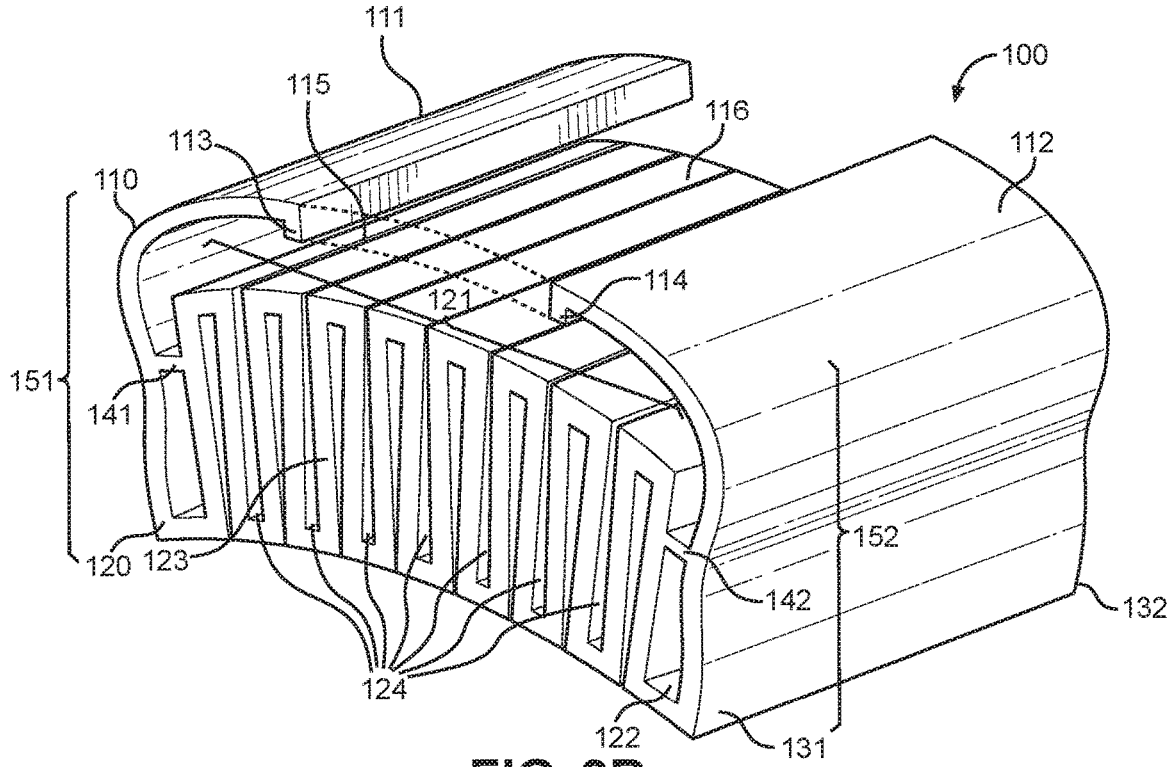
FIG. 2B shows a perspective view of the base member of the variable radius sanding block in a flexed position.

Referring now to FIGS. 2A and 2B there is shown a perspective view of the base member of the variable radius sanding block in a resting position and a flexed position, respectively. The base member 100 includes a top end 110 and a bottom end 120, such that the top end 110 includes a left flexible arm 111 and a right flexible arm 112. Together the two arms 111,112 form an incomplete arch 115 and define an opening 116. The opening 116 is sized and proportioned to allow any of the variably sized radius patches 200 to be inserted into the base member 100, thereby completing the arch 115 to form a continuous upper surface, as seen in FIG. 1. The radius of the arch 115 being adjustable based on the width and size of the radius patch 200 that is inserted. The flexible arms 111,112 are configured to collapse inward to make the opening 116 smaller or expand outwards to make the opening 116 larger depending on the size of the radius patch 200 to be inserted. Furthermore, each flexible arm 111, 112 of the base member 100 includes a protruding lip 113 on the left arm and 114 on the right arm. Each protruding lip 113, 114 is configured to secure any of the variably sized radius patches 200 in place once inserted into the base member 100.

In the illustrated embodiment, the bottom end 120 of the base member 100 also includes a folded spring 123 having a plurality of expandable segments 124 that operably connect an outermost left side 151 to an outermost right side 152, such that each expandable segment 124 can expand or contract to control the position of the two flexible arras 111, 112 in the top end 110, and when combined the expandable segments 124 define a smooth upper surface 121 configured to receive the radius patches 200 when inserted, such that a bottom end 220 of radius patch 200 (see FIG. 4) is flush against the smooth upper surface 121 when inserted. Additionally, the folded spring 123 that connects the outermost left side 151 to the outermost right side 152 across the entire length of the base member 100 between the two opposing faces 131, 132.

In use, when a radius patch 200 is inserted into the base member 100 the expandable segments 124 of the folded spring 123 are configured to flex or spread apart to form a concave curve at a lower surface of the folded spring 123 and a convex curve at an upper surface thereof (see FIG. 2B) so that the flexible arms 111, 112 in the top end 110 of the base member 100 are able to collapse inward and expand outward. The lateral sides of the radius patch bear against the flexible arms and exert force thereto. More specifically, when the expandable segments 124 of the folded spring 123 move to a flexed position to form the convex curve, the flexible left arm 111 is forced to flare outward because the left arm 111 forms the upper portion of the outermost left side 151 that is operably connected to the folded spring 123 by means of a left connecting joint 141. The flexible right arm 112 is similarly forced to flare outward because the right arm 112 also forms the upper portion of the outermost right side 152 that is operably connected to the folded spring 123 by means of a right connecting joint 142.

Figure 3:
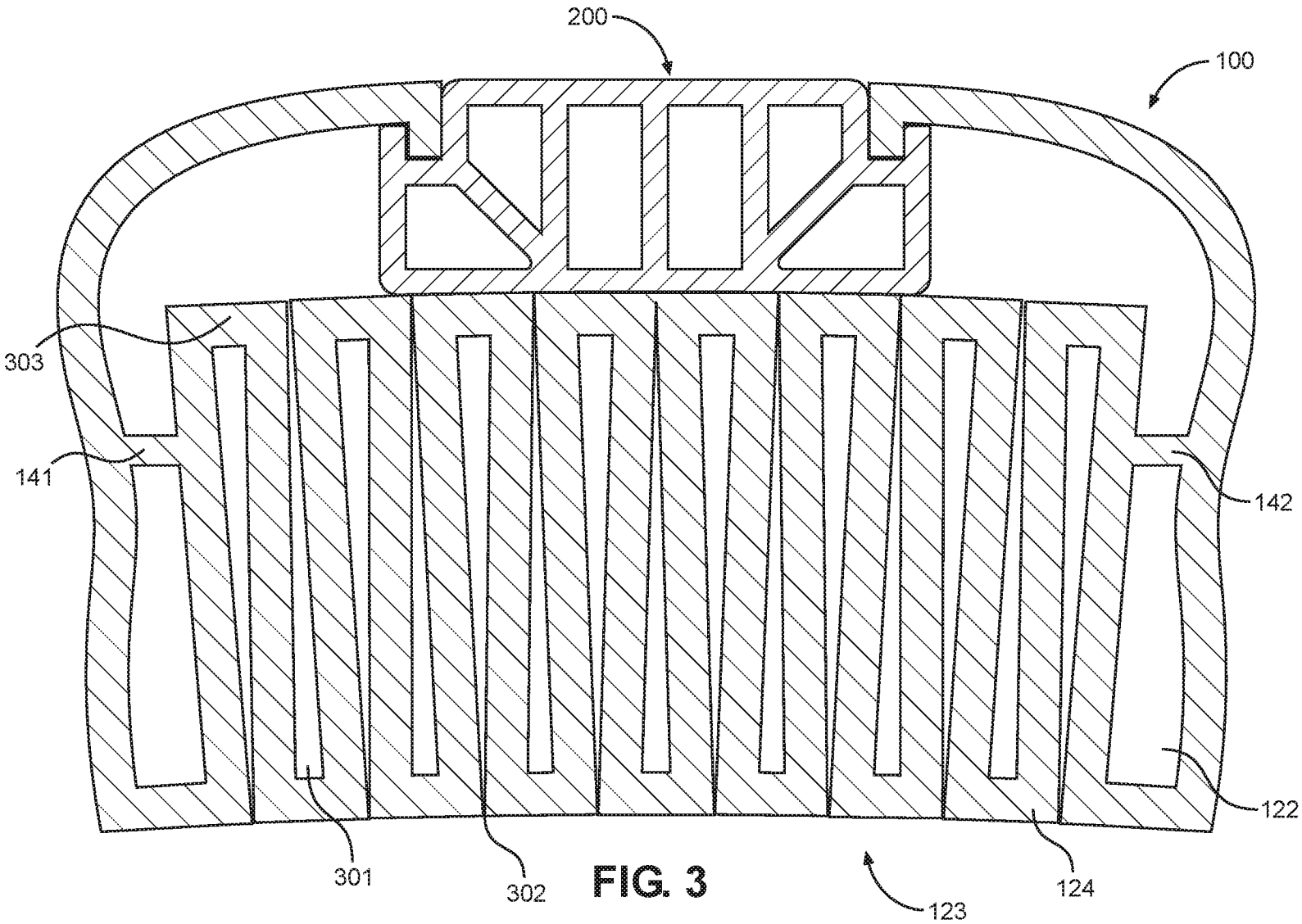
FIG. 3 shows a cross-sectional view of the base member of the variable radius sanding block.

Referring now to FIG. 3, there is shown a cross-sectional view of the base member of the variable radius sanding block. In the illustrated embodiment, the expandable segments 124 of the folded spring 123 form a plurality of overlapping folds, wherein each expandable segment 124 comprises a gap 301 having a triangular cross section when in the resting position. The gaps 301 each include an open end 302 and a closed end 303, wherein each end 302, 303 alternate in orientation between adjacent expandable segments 124. The expandable segments 124 are biased to remaining in a closed position such that the open end 302 of the gap 301 remains closed when the base member 100 is disposed in a resting position. In operation, when the base member 100 is flexed in order to receive the radius patch 200 and form the desired curvature, the open ends 302 of the gaps 301 are configured to open relative to the size of the radius patch 200 received by the base member 100.

In the illustrated embodiment, outermost openings 122 are formed between the bottom of the base member and the connected joints 141, 142. These outermost openings 122 provide additional ability for the folded spring 123 to flex. Further the outermost openings 122 and expandable segments 124 extend entirely through the base member 100, between the two opposing faces.

Figure 4:
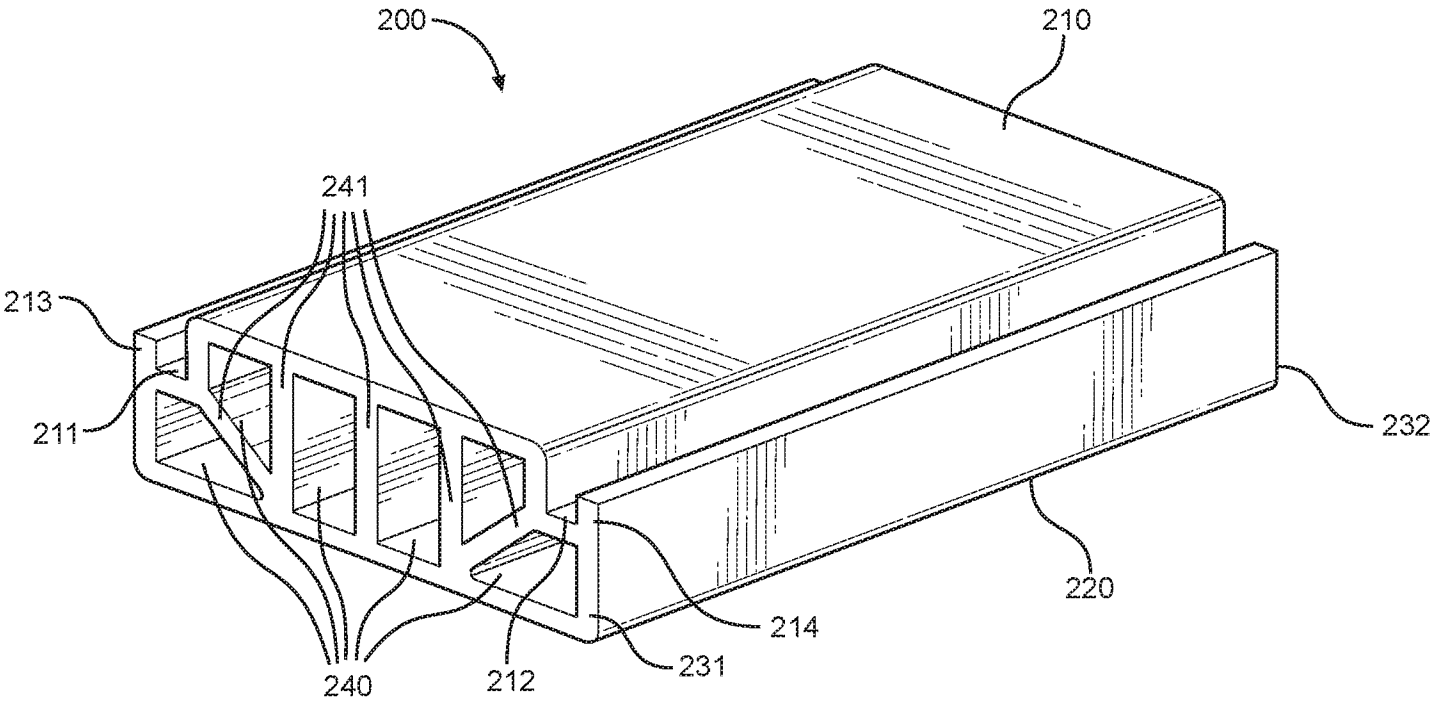
FIG. 4 shows a perspective view of a radius patch of the variable radius sanding block.

Referring now to FIG. 4, there is shown a perspective view of radius patch. In the illustrated embodiment, the radius patch comprises a top end 210, a bottom end 220, a left side wall 213, a right side wall 214, and a plurality of chambers 240 defined by partitions 241 that run along the length of the radius patch 200 between the two opposing faces 231, 232. In the illustrated embodiment, the bottom end 220 of each patch 200 includes a smooth surface configured to rest flush on top of the upper surface 121 of the folded spring 123 of the base member 100 (see FIG. 2A) when positioned therein.

In the illustrated embodiment, the top end 210 of each radius patch 200 includes a pair of grooves 211, 212 on the left side and on the right side, both being sized and proportioned to allow the protruding lips 113, 114 of the flexible arms 111, 112 of the top end 110 of the base member 100 to pass through upon insertion. Additionally, in the illustrated embodiment, the grooves 211, 212 and the protruding lips 113, 114 of the flexible arms 111, 112 are used as the primary means of securing the radius patch 200 to the base member 100 upon insertion.

Furthermore, the illustrated embodiment allows for a push clip installation method for inserting the radius patch 200 into the base member 100. In using the push clip installation method, the radius patch 200 is first placed in the opening 116 such that the flexible arms 111, 112 of the base member 100 rest against the side walls 213, 214. Next while firmly pressing downward on the radius patch 200 in the opening 116, squeeze the flexible arms 111 and 112 inward toward one another. Finally, upon exerting sufficient force the protruding lips 113, 114 of the base member 100 will snap into the grooves 211, 212 of the radius patch 200. After the radius patch is inserted and the sanding block 1000 is assembled the bottom end 120 of the base member is covered by sand paper and used to sand a curved surface. In the illustrated embodiment, sandpaper is adhesively fastened to the surface of the bottom end 120.

Figure 5:
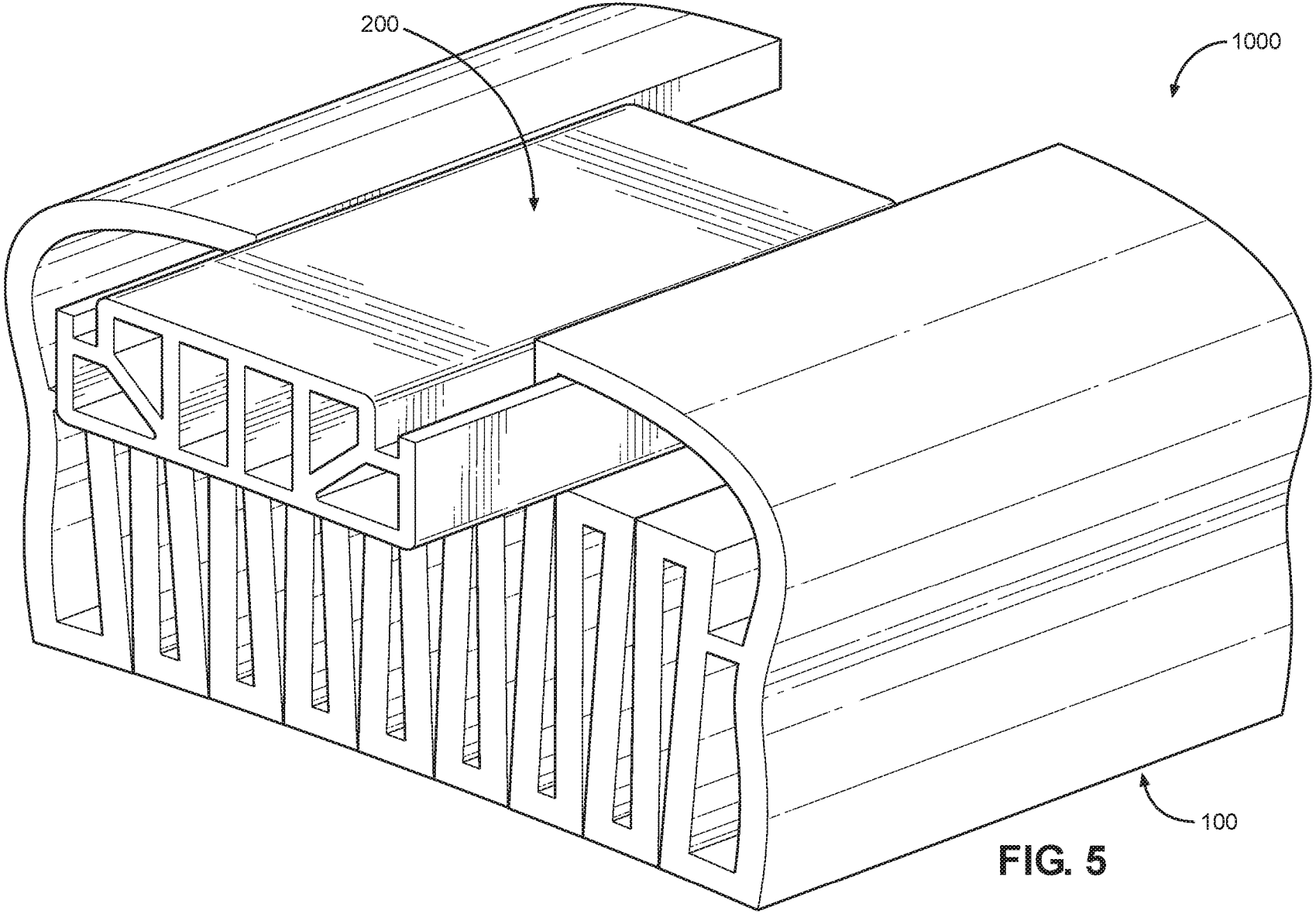
FIG. 5 shows a perspective view of a radius patch partially inserted into the base member of the variable radius sanding block.

Referring now to FIG. 5, there is shown a perspective view of a radius patch partially inserted into the base member of the variable radius sanding block. In the illustrated embodiment the smooth surface of the bottom end 220 of the radius patch 200 is shown sliding along the smooth upper surface 121 of the folded spring 123 of the base member 100. Also, the flexible arras 111, 112 of the top end 110 of the base member 100 are shown moving through the grooves 211, 212 of the radius patch.

Figure 6:
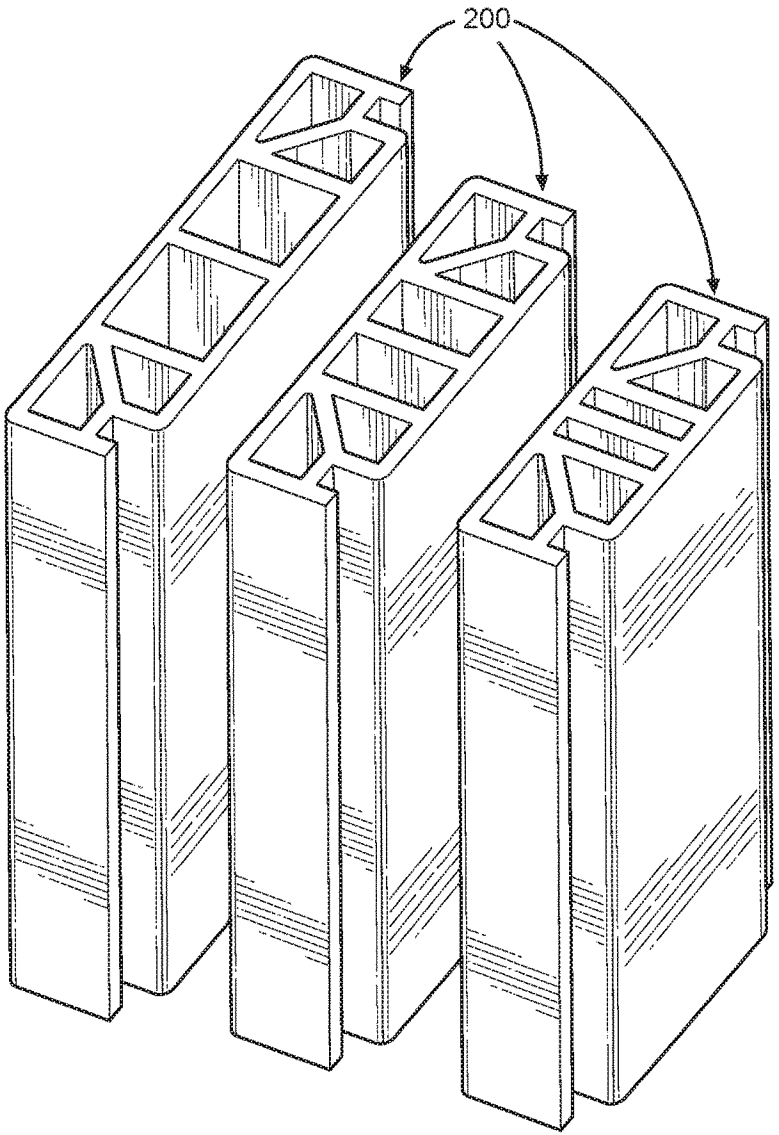
FIG. 6 shows a perspective view of an embodiment of the fully assembled variable radius sanding Block alongside additional radius patches of varying size.

Referring now to FIG. 6, there is shown a perspective view of fully assembled variable radius sanding block alongside additional radius patches of varying size. In the illustrated embodiment each radius patch 200 has a width corresponding to a different radius, such that wood workshops would be able to sand a wide range of surfaces with a single base member 100 in combination with radius patches 200 of varying size, and a sheet of sand paper. In other embodiments the size of each patch 200 also corresponds to a specific color according to a color coding system.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A variable radius sanding block comprising:

a base member and a radius patch;

the base member having a top end and a bottom end, wherein the top end comprises two flexible arms that define an opening;

the arms configured to collapse inward, making the opening smaller, and expand outwards, making the opening larger;

the radius patch removably disposed within the opening of the base member;

wherein each arm includes a fastener configured to secure the radius patch once inserted into the base member;

wherein the bottom end includes a folded spring having a plurality of expandable segments that operably connect an outermost left side of the base member to an outermost right side of the base member, such that the folded spring moves between a resting position to a flexed position;

in the flexed position the expandable segments form a first curve and in the resting position the expandable segments form a second curve.

2. The variable radius sanding block of claim 1, further comprising a plurality of variably sized radius patches, wherein each radius patch of the plurality of radius patches are interchangeable within the opening.

3. The variable radius sanding block of claim 2, wherein each radius patch has a top end, a bottom end, and a plurality of chambers defined by partitions that run along a length of the patch.

4. The variable radius sanding block of claim 2, wherein each radius patch has a width corresponding to a different radius than one another.

5. The variable radius sanding block of claim 1, wherein the fastener is a protruding lip.

6. The variable radius sanding block of claim 5, wherein a top end of each radius patch includes a pair of grooves, sized and proportioned to allow the protruding lips of the flexible arms of the top end of the base member to pass through.

7. The variable radius sanding block of claim 6, wherein the pair of grooves in the top end of the patch and the protruding lips of the flexible arms of the base member are configured to interlock with one another to further secure the patch when inserted.

8. The variable radius sanding block of claim 2, wherein a bottom end of each radius patch has a smooth surface configured to slide along and rest on top of the combined segments of the folded spring disposed in the base member.

9. The variable radius sanding block of claim 2, wherein each radius patch corresponds to a different color.

10. The variable radius sanding block of claim 1, wherein each arm forms an incomplete arch when the radius patch is not disposed within the opening and form a complete the arch when the radius patch is disposed within the opening, thereby forming a continuous upper surface.

11. The variable radius sanding block of claim 1, wherein each expandable segment comprises a gap having an open end and a closed end such that an open end of a first expandable segment alternates in orientation with a closed end of a second, adjacent expandable segment.

* * * * *